United States Patent [19]

Hofer

[11] 4,407,656

[45] Oct. 4, 1983

[54] GETTERING DEVICE AND METHOD

[75] Inventor: Franz Hofer, Eindhoven, Netherlands

[73] Assignee: U.S. Philips Corporation, New York, N.Y.

[21] Appl. No.: 261,993

[22] Filed: May 8, 1981

[30] Foreign Application Priority Data

May 16, 1980 [NL] Netherlands ..... 8002836

[51] Int. Cl.[3] ..... H01J 9/20

[52] U.S. Cl. ..... 445/10; 445/55; 445/17; 252/181.2; 252/181.6

[58] Field of Search ..... 316/3, 25; 417/48; 252/181.2, 181.4, 181.6; 206/0.7; 75/123 N

[56] References Cited

U.S. PATENT DOCUMENTS 4,111,689 9/1978 Liu ..... 75/123 N 4,203,860 5/1980 Ichise et al. ..... 316/3 X

*Primary Examiner*—Kenneth J. Ramsey

*Attorney, Agent, or Firm*—Robert J. Kraus

[57] ABSTRACT

The invention relates to a method of manufacturing a color television display tube having an envelope including a conical portion (11) and a window portion (12) which are sealed together in a vacuum-tight manner by means of a sealing glass (18). Before these portions are sealed together, a gettering device (21) is assembled in a place inside the envelope of the tube, for example to the internal magnetic screening cap (17) or the high-voltage contact (26). The gettering device (21) comprises a source of evaporable gettering metal and at least one gas source formed from a material which releases gas upon heating. The gas-releasing material includes a nitrided pulverulent ternary alloy of iron, germanium and at least one of the metals chromium and manganese. Such a gas-releasing material can be exposed to moist air of 450° C. for at least one hour without any deterioration, which conditions occur when the window portion (12) and the conical portion (11) are sealed together.

12 Claims, 2 Drawing Figures

GETTERING DEVICE AND METHOD

BACKGROUND OF THE INVENTION

The invention relates to a method of manufacturing a colour television display tube the envelope of which comprises a conical portion and a window portion which are sealed together in a vacuum-tight manner by means of a sealing glass prior to sealing said portions together, a gettering device is provided in a place situated inside the envelope of the tube, which gettering device comprises a source of evaporable gettering metal and at least one gas source of a material releasing gas upon heating. After evacuation of the display tube, the gas is released from the gas source and the gettering metal is evaporated.

The invention furthermore relates to a colour television display tube thus manufactured, as well as to a gettering device which is suitable inter alia for use in the above-mentioned method.

A method of the kind described above is disclosed in British Patent Specification No. 1,405,045. The usefulness of a gettering device is determined to a considerable extent by the extent to which it can withstand the action of the ambient atmosphere. The chemical composition of the constituents of the gettering device must not vary prematurely under the conditions prevailing during storage of the gettering device or during the manufacture of the tubes in which they are used. In this respect problems present themselves in particular when the gettering device is provided in the tube before the display window of the tube is sealed to the cone of the tube by means of a sealing glass. The sealing of said envelope portions takes place in a furnace at a temperature of approximately 450° C. and lasts approximately one hour, the furnace atmosphere being moist during this process. The components of the gettering device cannot withstand the action of this atmosphere. With regard to the gas source of the gettering device, British Patent Specification No. 1,405,045 proposes the use of a gas-releasing material consisting of germanium nitride ($Ge_3N_4$). Germanium nitride ($Ge_3N_4$) is a chemically resistant compound which decomposes at approximately 900° C. As a result of this high decomposition temperature, the nitrogen released from said gas source builds up a sufficient gas pressure in the tube only during the evaporation of the gettering metal to obtain the desired scattering effect on the evaporating gettering metal. As is known, as a result of this scattering effect which the nitrogen exerts on the evaporating gettering metal, a porous, uniformly distributed layer of gettering metal is obtained on an inner surface of the tube. In order to obtain a layer of gettering metal which is porous throughout the thickness of the layer and hence is readily absorbent, it is necessary that during the heating of the gettering device the gas released from the gas source has built up a sufficient gas pressure of approximately $133\times10^{-3}$ to $666\times10^{-2}$ Pa in the tube before the gettering metal begins to evaporate.

The source from which the gettering metal is evaporated usually consists of a mixture of powdered nickel and a powdered alloy of a gettering metal and aluminium. Suitable gettering metals are barium, strontium, calcium and magnesium. A frequently used source of gettering metal consists of a mixture of nickel powder and barium-aluminium powder ($BaAl_4$) in which the content of nickel powder is approximately 40–60% by weight.

As regards the source of gettering metal, it has already been suggested to replace the nickel powder in the mixture by a more chemically resistant material, for example, a nickel-titanium compound or an iron-titanium compound. When using a source of gettering metal consisting of a mixture of barium-aluminium powder ($BaAl_4$) and nickel powder, a very suitable measure to improve the chemical resistance of the mixture is described in U.S. Pat. No. 4,077,899, the contents of which are considered to be incorporated herein by reference. In accordance with this measure the nickel powder has an average grain size smaller than 80 microns and a specific area smaller than 0.15 $m^2$ per gram, while the average grain size of the barium aluminium powder is smaller than 125 microns.

SUMMARY OF THE INVENTION

It is an object of the invention to provide a method of manufacturing a colour television display tube in which a gettering device is used which, prior to sealing the conical portion to the window portion of the tube, can be provided in a place situated inside said conical portion or window portion and which can be exposed without any deterioration to moist air at approximately 450° C. for at least one hour, while on heating the gettering device the gas source has given off at least a considerable proportion of its gas before the gettering metal begins to evaporate.

According to the invention, a method of the kind mentioned in the opening paragraph is characterized in that the gettering device has a gas source comprises a gas-releasing material including of a nitrided pulverulent ternary alloy of iron, germanium and at least one of the metals chromium and manganese.

The term "nitriding" is to be understood to mean herein a process of forming metal nitride wherein the conversion may be less than 100%.

The gettering device comprises a chemically resistant source of evaporable gettering metal, that is a source of gettering metal which is not deleteriously affected by exposure to a moist atmosphere at 450° C. for one hour. An example of such a chemically resistant source of gettering metal consists of a mixture of nickel powder and $BaAl_4$ powder, this mixture containing from 40 to 60% by weight of nickel, the nickel powder having a specific surface of less than 0.15 $m^2$ per gram and an average grain size smaller than 80 $\mu$m, the $BaAl_4$ powder having an average grain size smaller than 125 $\mu$m, as described in U.S. Pat. No. 4,077,899. Alternatively the source of gettering metal may be covered with an aluminium foil, or the surface of the source of gettering metal may be covered by a protective layer, for example, of aluminium or an organosilicon compound.

The invention is based on the recognition obtained by investigations which led to the invention, that the requirements imposed as regards chemical resistance and decomposition temperature of the gas releasing material can be satisfied by using gas-releasing materials consisting of nitrided alloys of iron, germanium, together with chromium and/or manganese. It has been found that the temperature at which said nitrided alloys begin to decompose in a vacuum is determined in particular by the iron content. In general, a higher iron content produces a lower decomposition temperature. The chemical resistance of the gas-releasing material generally is larger with a larger germanium content. Furthermore, nitrided alloys of iron, germanium, together with at least one of the metals chromium and manganese generally have an increasing nitrogen take-up as the chromium and/or manganese content increases. By a suitable choice of the alloying elements, therefore, the chemical resistance and the decomposition temperature of the gas-releasing material can be fixed as desired and as needed. An economic advantage resulting from the invention is that a considerable part of the comparatively expensive germanium is replaced by the less expensive elements iron, chromium and/or manganese. In one embodiment of the method in accordance with the invention, a gettering device is used in which the gas source comprises a gas-releasing material which substantially consists of a nitrided ternary alloy containing 30–80% by weight of iron; 5–50% by weight of germanium and up to 30% by weight of chromium and/or manganese. In a very attractive embodiment with respect to decomposition temperature, chemical resistance and the quantity of nitrogen given off upon heating, a gettering device is used in which the gas-releasing material of the gas source consists substantially of a nitrided alloy containing about 60% by weight of iron, 7% by weight of chromium and 33% by weight of germanium.

According to a further embodiment of the invention, a gettering device may contain a first gas source and at least a second gas source, the second gas source comprising a gas-releasing material having a higher decomposition temperature than that of the first gas source. The advantage of this gettering device is that the scattering effect which the gas exerts on the evaporating gettering metal takes place over a longer period of time than when a gas-releasing material having one decomposition temperature is used. The gas-releasing materials of the gas sources may consist of nitrided alloys having different contents of iron, germanium together with manganese and/or chromium. According to a particular embodiment of the invention, a gettering device is used wherein a first gas source consists at least substantially of a nitrided alloy of iron, germanium and chromium and/or manganese and a second gas source consists at least substantially of germanium nitride ($Ge_3N_4$). The gas-releasing materials of the gas sources may be incorporated in the gettering device while mixed or separated from each other (for example, in separate holders).

It is to be noted that in this connection German Offenlegungsschrift No. 2,145,159 corresponding to U.S. Pat. No. 4,203,860 discloses a gettering device having a gas source consisting of a mixture of $Fe_2Ge$-nitride and $FeGe_2$-nitride by which it is also endeavoured to extend the scattering effect which the gas released therefrom exerts on the evaporating gettering metal over a longer period of time. However, the German Offenlegungsschrift does not relate to a method in which the gettering device is provided in its place in the tube prior to the sealing together of the window portion and the conical portion. German Offenlegungsschrift No. 2,145,159 furthermore does not teach anything as regards the chemical resistance of the gas source or the source of gettering metal.

In general the preparation of the nitrides is carried out via a reaction between a solid and a gas. A suitable method is that in which first an alloy of the desired composition is made. This alloy is ground to form a powder and this powder is nitrided in an ammonia atmosphere at a suitable nitriding temperature between approximately 500° C. and 800° C. Besides the composition of the alloy, the quantity of nitrogen which is taken up by the alloy also depends on the grain size of the powdered alloy and the time during which the alloy is subjected to the nitriding process. A nitrogen content of approximately 5% by weight in the alloy is generally sufficient for use as a gas source in a gettering device. As regards the capability of such a nitride to withstand moist air at 450° C., it has been found that if desired, an increased resistance can be obtained when the nitriding process is carried out in at least two steps. The powdered alloy is nitrided a first time, then ground again to form a powder having a smaller grain size, and then nitrided a second time.

The gettering device described is very suitable for use in manufacturing colour television display tubes. However, the gettering device may alternatively be used in the manufacture of black-and-white display tubes. The resistance of the gettering device to the action of the ambient atmosphere is a great advantage because this permits storage of the gettering device for a long period of time without the usefulness of the gettering device being reduced.

BRIEF DESCRIPTION OF THE DRAWING

Some embodiments of the invention will now be described in greater detail, by way of example, with reference to the accompanying drawing, in which.

Figure 1:
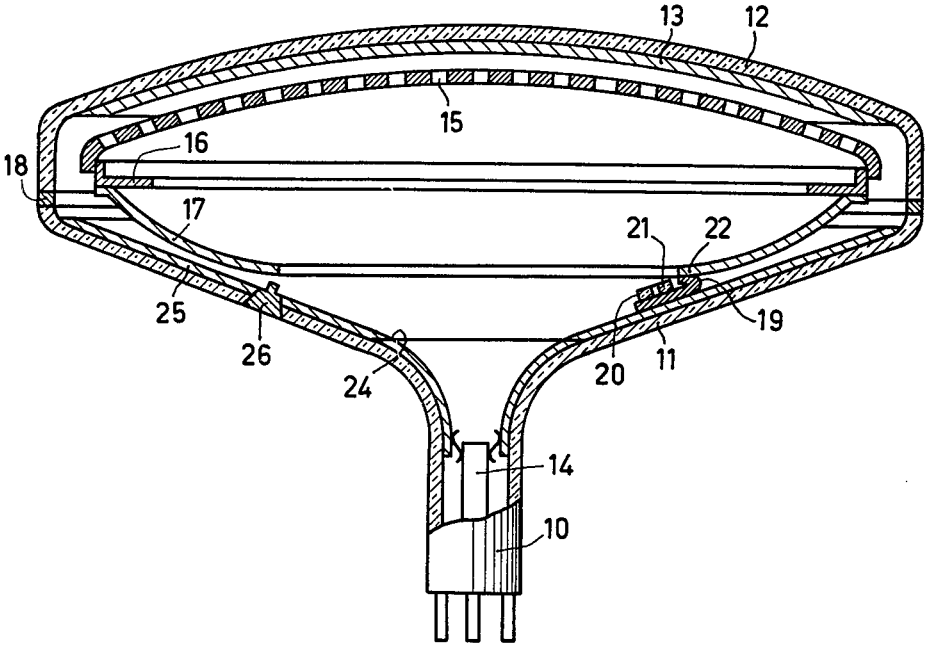
FIG. 1 is an axial sectional view of a colour television display tube manufactured by a method according the invention.

The colour television display tube shown in FIG. 1 has a neck 10, a cone 11 and a window 12 which are all made of glass. A layer 13 of areas luminescing in red, green and blue is provided on the inside of the window 12 and in known manner forms a pattern of lines or a pattern of dots. A metal shadow mask 15 and a metal magnetic screening cap 17 are both secured to a metal carrier frame 16. The cone 11 and the window 12 are sealed together by means of a sealing glass 18. Before the window 12 and the cone 11 are assembled together, a gettering device 21 is provided in the conical portion 11. The gettering device 21 is connected to the screening cap 17 by means of a metal strip 19. It is alternatively possible to connect the strip 19 to a high voltage contact 26 sealed in the tube wall. After providing the gettering device 21 in its place, the window 12 and the cone 11 are sealed together in a vacuum-tight manner, which process is carried out in a furnace at a temperature of approximately 450° C. and lasts for approximately 1 hour. The tube is then finished in the usual manner by placing a system of guns 14 in the neck, evacuating the tube and providing a layer of gettering metal on an internal surface of the tube by inductively heating the gettering device 21.

One reason for providing the gettering device in the tube at such an early stage of manufacture is due to the fact that the tube comprises an internal resistive layer 25. This resistive layer 25 as is known, restricts the current flowing through it when a high voltage breakdown occurs, for example, in the gun system 14. The most effective part of this resistive layer 25 is formed by the part thereof extending approximately from the neck-cone transition denoted by the line 24 into the neck 10. This makes it necessary to locate the gettering device 21 in a place in the tube remote from the neck-cone transition so as to avoid electrically short-circuiting the resistive layer in the neck 10 by gettering metal evaporated from the gettering device 21. Because of the inaccessibility of the above-mentioned place, it is necessary to have the ability of providing the gettering device in this place remote from the neck-cone transition before the cone 11 is sealed to the window 12 of the tube. The gettering device may be provided in this manner, for example, when the usual assembly of the gettering device to the gun system 14 by means of a resilient metal strip is avoided to eliminate the resilience imposed on the gun system by said metal strip. Providing the gettering device before sealing makes it necessary for the constituents of the gettering device to be able to withstand the action of the moist ambient atmosphere at approximately 450° C. which is present in the tube during the sealing together of the cone 11 and the window 12.

Figure 2:
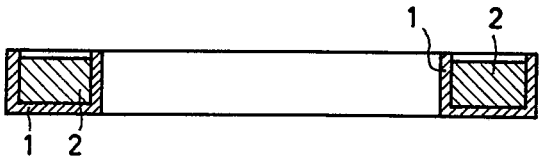
FIG. 2 shows a side-sectional elevation of a gettering device suitable for use in this method.

A gettering device which satisfies this requirement is shown in FIG. 2. This gettering device comprises a chromium-nickel steel channel 1 in which a powdered filling material 2 is compressed. The filling material 2 comprises a source of gettering metal consisting of a mixture of barium-aluminium powder ($BaAl_4$) and nickel powder containing from 40 to 60% by weight of nickel powder, as well as a gas source consisting of from approximately 1.5–4% by weight (expressed in terms of the total quantity of filling material) of gas-releasing material consisting of a nitride of a powdered alloy of 60% by weight of iron, 7% by weight of chromium and 33% by weight of germanium, this nitride having an average grain size between 10 and 40 microns. This gas source starts giving off its nitrogen at approximately 615° C. During the inductive heating of the gettering device, said gas source gives off its gas before the barium begins to evaporate from the source of gettering metal.

Both the gas source and the source of gettering metal should be capable of withstanding the action of moist air at 450° C. for at least one hour. This can be realized by a suitable choice of the grain sizes of the barium aluminium powder and the nickel powder as described in the above-mentioned U.S. Pat. 4,077,899. In the embodiment described, the nickel powder has an average grain size between 30 and 60 microns and the barium aluminium powder has an average grain size of approximately 80 microns. The specific area of the nickel powder is smaller than 0.15 $m^2$ per gram. It is also possible to improve the chemical resistance of the source of gettering metal by replacing the nickel therein by a nickel-titanium or iron-titanium compound.

Gas-releasing materials of nitrides of alloys of iron, germanium and chromium generally have a decomposition temperature between 500° C. and 700° C. and remain fully useful as a nitrogen source even after being exposed for one hour to moist air (dew point approximately 20° C.) at 450° C. As a measure of the chemical resistance of the gas-releasing material, the increase in weight is determined which the material shows after having been exposed to moist air (dew point 20° C.) at 450° C. for one hour. The higher the increase in weight, the smaller is the chemical resistance. The nitrides in question only showed an increase in weight of on an average 0.5% by weight and at most approximately 1.5% by weight, which satisfies the object of the invention. Although not strictly necessary, a further increase of the chemical resistance can be obtained by carrying out the nitriding process in steps. A powdered alloy having a grain size of, for example, 30 microns is then nitrided for a first time for a period of time of, for example, four hours, then pulverized again to form a powder having a smaller grain size (for example 15 microns) and then nitrided again for a period of time, for example, of four hours. Compared with a powdered alloy which was nitrided once for a period of approximately eight hours, the above-mentioned chemical resistance of the alloy nitrided in steps proved to be better by a factor of approximately two. The brittleness of the nitrided material which has increased as a result of a first nitriding process moreover facilitates the pulverization thereof to a smaller grain size.

With respect to the properties of the gas-releasing material, the elements chromium and manganese may be considered to be substantially equal. Entire or partial replacement of chromium by manganese will not unacceptably change the chemical resistance or the decomposition temperature of the gas-releasing material.

What is claimed is:

1. A method of manufacturing a colour television display tube having an envelope comprising a conical portion and a window portion which are sealed together in a vacuum-tight manner by means of a sealing glass, a gettering device being provided in a place situated inside the envelope of the tube before said portions are sealed together, said gettering device comprising a source of evaporable gettering metal and at least one gas source including a material which releases gas upon heating, the gas being released from the gas source after evacuating the display tube and while the gettering metal is evaporated, characterized in that said gas-releasing material comprises a nitrided pulverulent ternary alloy of iron, germanium and at least one of the metals chromium and manganese.

2. A method as claimed in claim 1, characterized in that the gas-releasing material comprises a nitrided alloy including 30–80% by weight of iron, 5–50% by weight of germanium, and up to 30% by weight of chromium and/or manganese.

3. A method as claimed in claim 1 or claim 2, characterized in that the gas-releasing material comprises a nitrided alloy including about 60% by weight of iron, 7% by weight of chromium and 33% by weight of germanium.

4. A method as claimed in claim 1 or 2, characterized in that a gettering device is used which comprises a first gas source and at least a second gas source, said second gas source comprising a gas-releasing material having a higher decomposition temperature than the decomposition temperature of the gas-releasing material of the first gas source.

5. A method as claimed in claim 4, characterized in that the gas-releasing material of the first gas source comprises a nitrided alloy of iron, germanium and at least one of the metals chromium and manganese, and the second gas source comprises germanium nitride ($Ge_3N_4$).

6. A method as claimed in claim 1 or 2, characterized in that the gas-releasing material comprises a nitride of an alloy in powder form obtained by successively pulverizing and nitriding the alloy at least twice.

7. A gettering device comprising a source of evaporable gettering metal and at least one gas source including gas-releasing material in powder form, characterized in that said gas-releasing material comprises a nitrided pulverulent ternary alloy of iron, germanium and at least one of the metals chromium and manganese.

8. A gettering device as claimed in claim 7, characterized in that the gas-releasing material comprises a nitrided alloy including 30–80% by weight of iron, 5–50% by weight of germanium, and up to 30% by weight of chromium and/or manganese.

9. A gettering device as claimed in claim 7 or claim 8, characterized in that the gas-releasing material comprises a nitrided alloy including about 60% by weight of iron, 7% by weight of chromium and 33% by weight of germanium.

10. A gettering device as claimed in claim 7 or 8, characterized in that the gettering device comprises a first and at least a second gas source, said second gas source comprising a gas-releasing material having a higher decomposition temperature than that of the first gas source.

11. A gettering device as claimed in claim 10, characterized in that the gas-releasing material of the first gas source comprises a nitrided alloy of iron, germanium and at least one of the metals chromium and manganese, and the second gas source comprises germanium nitride ($Ge_3N_4$).

12. A gettering device as claimed in claim 7 or 8, characterized in that the gas-releasing material comprises a nitrided alloy obtained by successively pulverizing and nitriding the alloy at least twice.

* * * * *